United States Patent [19]

Hepko

[11] Patent Number: 4,592,312

[45] Date of Patent: Jun. 3, 1986

[54] HIGH EFFICIENCY PERFORMANCE KINETIC OCCLUDE SYSTEM WITH ROTARY VALVE

[76] Inventor: Samuel Hepko, Rte. 1, Box 2170-1, Branson, Mo. 65616

[21] Appl. No.: 649,699

[22] Filed: Sep. 12, 1984

[51] Int. Cl.[4] ..... F01L 7/00

[52] U.S. Cl. ..... 123/80 BB; 123/190 B; 123/190 BD; 123/81 B

[58] Field of Search ..... 123/193 P, 190 B, 190 BD, 123/80 BB, 80 C, 81 R, 81 B, 661

[56] References Cited

U.S. PATENT DOCUMENTS

| | | | |
|---|---|---|---|
| 821,227 | 5/1906 | Elliott | 123/81 B |
| 1,010,754 | 12/1911 | Hall | 123/47 AA |
| 1,177,698 | 4/1916 | Good | 123/80 BB |
| 1,232,849 | 7/1917 | Russell . | |
| 1,361,978 | 12/1920 | George | 123/81 B |
| 1,580,720 | 4/1926 | Gold | 123/47 AA |
| 1,777,464 | 8/1929 | Edwards . | |
| 1,924,188 | 10/1929 | Hall . | |
| 1,974,454 | 9/1934 | Gamache | 123/81 B |
| 3,274,901 | 9/1964 | Yost . | |
| 3,989,025 | 11/1976 | Franco . | |

FOREIGN PATENT DOCUMENTS

| | | | |
|---|---|---|---|
| 128617 | 10/1980 | Japan | 123/661 |
| 597729 | 2/1948 | United Kingdom | 123/661 |
| 2106592 | 4/1983 | United Kingdom | 123/661 |

*Primary Examiner*—Ronald H. Lazarus
*Attorney, Agent, or Firm*—Kalish & Gilster

[57] ABSTRACT

An internal combustion engine is provided with intake and exhaust gas valving by a single rotary valve mounted within a jacketed housng atop the cylinder. The piston has a shaft extending up through the housing, the shaft defining multiple spirals wound in opposite directions for engagement by a pair of slipring drivers. Such drivers alternately engage sliprings carried by the valve for incrementally rotating the valve in a single direction of rotation as the piston reciprocates. The valve has at least one recess for providing communication between intake and exhaust gas passages as it rotates.

11 Claims, 6 Drawing Figures

FIG. 1
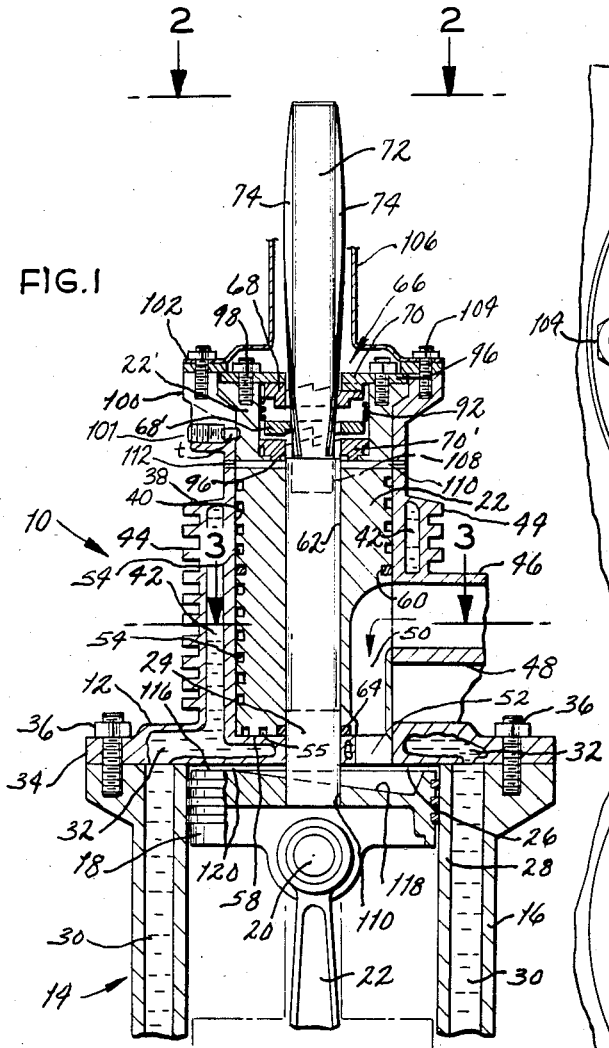
FIG. 2
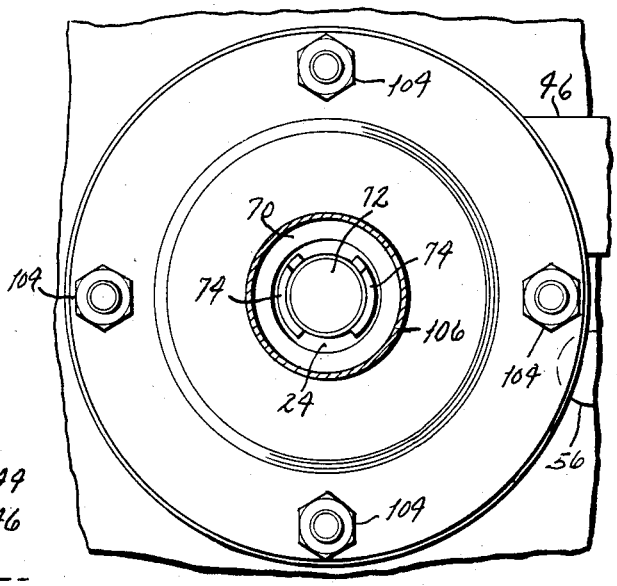
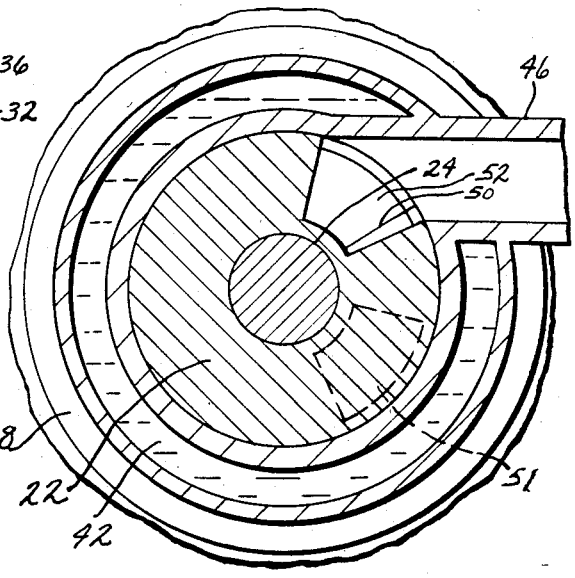
FIG. 3
FIG. 6
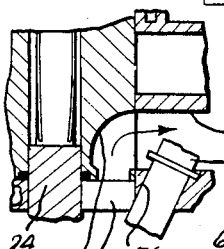
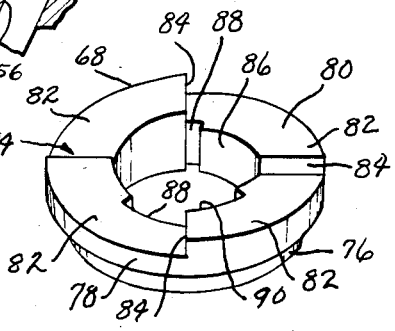
FIG. 4
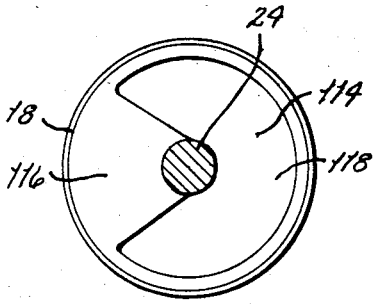
FIG. 5

HIGH EFFICIENCY PERFORMANCE KINETIC OCCLUDE SYSTEM WITH ROTARY VALVE

BACKGROUND AND SUMMARY OF THE INVENTION

The present invention relates to internal combustion engines and, more particularly, to an improved rotary valve mechanism and cylinder head assembly for internal combustion engines, including gasoline, diesel and other types.

The use of rotary valves with internal combustion engines has been long known. Thus, in Russell U.S. Pat. No. 1,232,849, which issued in 1917, there was proposed a rotary valve mechanism for use not only with what were then misunderstandingly referred to as "explosive motors" but also steam engines, pumps and other machinery in which valves were employed. Such arrangement included a valve member positioned above a cylinder head assembly wherein the valve member rotated upon a horizontal axis, being driven by a shaft carrying a gear wheel for geared relationship with a valve timing and driving mechanism of undisclosed construction.

In 1930, U.S. Pat. No. 1,777,464 issued to W. M. Edwards upon a rotary valve mechanism for an internal combustion engine wherein, again, the valve was positioned for rotation upon an axis parallel to the axis of rotation of the crank shaft, being driven by it through a bevel gear arrangement, and the valve being located within a finned housing. Such valve controlled intake and exhaust of gases relative to the combustion chamber.

Then, in 1933, U.S. Pat. No. 1,924,188 of C. W. Hall issued upon a rotary valve for internal combustion engines wherein, once again, a single rotary valve for each cylinder was carried on a shaft for rotation about an axis parallel to the crank shaft, there being multiple cylinders, each having such a valve on a single shaft. It was proposed to surround the valve housing with a water jacket in which coolant could circulate. Various passages were provided for flow along a path within the valve which extended along the axis of rotation. That is, there was longitudinal flow through the valve.

Not until 1966, in Yost U.S. Pat. No. 3,274,901 was there first disclosed, insofar as is known, the use of a rotary valve wherein the valve was permitted to rotate upon an axis which was perpendicular to the crankshaft. The rotary valve was provided with a flange which was permitted to rotate within the combustion chamber for opening and closing of inlet and exhaust gas passages communicating with the chamber, the valve including a central sleeve in which a helically grooved rod or core was caused to reciprocate by the piston for causing the valve and thereby its flange to oscillate, turning back and forth with each cycle of piston reciprocation. Such an arrangement presupposed two-cycle operation and provided a further limitation in what the valve, being located within the combustion chamber, was directly exposed in its entirety to the full heating effects of exhaust gas temperatures and corrosive effect of gases therein.

In U.S. Pat. No. 3,989,025 which issued only in 1976, Franco proposed a valve system wherein rotary valves were located on a transverse shaft parallel to the crank shaft and wherein the rotary valves, one for each of multiple cylinders, were each constructed of pressed graphite whereby such valves would be self-lubricating and self-fitting despite the high temperature associated with transfer of gases relative to the combustion chamber.

Among the problems of such prior art, as well as the many existing types of internal combustion engines which have utilized tulip valves and other more conventional designs, it is apparent that there is typically a complicated valve drive arrangement involving high friction forces, inefficiency, mass with excessive inertia, inefficiency with attendent loss of horsepower, and thermal problems. Thus, such valves of prior art designs are prone to being overheated and thereby being damaged by such heat, and are exposed to erosive effects not to mention the consequences of lubrication difficulties, all to the effect that the use of rotary valves in internal combustion engines has largely been abandoned.

It is an object of the present invention to provide a rotary valve mechanism and associated cylinder head design which provides an internal combustion engine with high efficiency performance, involving the kinetic occlusion of exhaust and intake gases to provide for elimination of timing gears, timing belts, chains, cam shafts, valve shafts, cams, tappets, pushrods, valve lifters, and various valve clearance adjustment mechanisms, as well as other apparatus typically associated with the exahust and inlet valve requirements of internal combustion engines.

It is a further object of the invention to provide such apparatus wherein its design principles conduce to true universality and flexibility of internal combustion engine design, being equally as well utilizable on engines of the Otto cycle (as for a gasoline or propane combustion) or the Diesel cycle, and further as being utilizable readily for engines operating according with either two- and four-stroke cycles.

It is a further object of the present invention to provide such apparatus which eliminates or reduces power losses heretofore associated and necessitated by conventional valve or valve drive mechanisms, including both conventional tulip valves as well as rotary valve designs of the prior art, being not only more efficient but also providing for a lower specific fuel consumption, it being also a related object of the present invention to permit a piston of lightened mass and reduced size for increased engine power, acceleration, reduced wear and lower costs.

Among still other objects of the invention may be noted the provision of such apparatus which allows cooler engine operation, being less prone to thermal problems of the prior art and not presenting either the frictional or the heat problems which have been heretofore associated with known valve constructions.

It is additionally an object of the present invention to provide such apparatus which is of extraordinary simplicity, making possible mass production manufacture of internal combustion engines with hitherto unachievable economy and ease of manufacture, conducing to economy, longevity of use, inherent reliability and lack of proneness to high stresses or other factors tending to cause fractures and other parts failure.

Other objects will be in part apparent and in part pointed out hereinbelow.

BRIEF DESCRIPTION OF THE DRAWINGS

FIG. 1 is a vertical cross sectional view, partly broken away, of cylinder head portions of an internal combustion engine configured with apparatus in accordance with and embodying the present invention, and herein designated high efficiency performance kinetic occlude system.

FIG. 2 is a top plan view of such apparatus, partially broken away and sectioned, as taken generally along line 2—2 of FIG. 1.

FIG. 3 is a horizontal cross sectional illustration of the apparatus of FIG. 1, as taken generally along line 3—3 thereof.

FIG. 4 is a perspective view of a certain slip ring driver utilized in the apparatus of FIG. 1.

FIG. 5 is a top plan view, partially sectioned, of a piston and related structure utilized in the construction of an engine in accordance with FIG. 1.

FIG. 6 is a fragmentary vertical cross section of cylinder head portions of the apparatus shown in FIG. 1, as taken generally along line 6—6 of FIG. 2, illustrating spark plug placement and passage features.

Corresponding reference characters indicate corresponding parts throughout the several views of the drawings.

DESCRIPTION OF THE PREFERRED EMBODIMENT

Referring to the drawings, indicated generally at reference numeral 10 is an engine cylinder assembly in which has been incorporated the present invention. The invention is termed a high efficiency performance kinetic occlude system. Such system includes a special cylinder head assembly 12 for an internal combustion engine, generally 14, having the usual jacketed cylinder or cylinder block 16 in which is reciprocal a piston 18 configured in accordance with the invention.

Connected by a wrist pin 20 to the piston is a connecting rod 21, the other end of which is journalled to a crankshaft (not shown) of conventional configuration. Engine 14 may, in this regard, have any conventional number of cylinders. But it will be understood that each cylinder, if more than one, will be equipped with a system of the invention.

Briefly, the new system comprises a rotary valve 22 which is driven by a shaft 24 carried by piston 18 and which reciprocates with it. Valve 22 is caused, for reasons soon to be apparent, to rotate by such movement of the piston for controlling the intake within a combustion chamber 26, defined by the cylinder 28 of assembly 10, of the usual air-fuel mixture and also for controlling the exhaust of combustion gases, as the engine goes through the strokes of its conventional working cycle.

Such working cycle may be the four-stroke Otto cycle, according to the embodiment illustrated. However, the principles of the invention may as well be adapted to engines operating with the two-stroke cycle as well as the Diesel cycle of operation. But, in any event, valve 22 rotates about an axis which at least is parallel to, and most preferably, coincident with the axis of cylindricity of cylinder 28. Thus, the valve rotation axis will be mutually perpendicular to the axis of rotation of the crankshaft. Referring now more specifically to FIG. 1, cylinder block 16 is provided with coolant passages 30 surrounding cylinder 28 which communicate with corresponding coolant passages 32 in a cylinder head 34 of head assembly 12, which is affixed to block 16 by conventional head bolts 36.

Head assembly 12 includes an upstanding housing 38 for valve 22, defining an internal cylindrical bore 40 in which the valve may rotate. For cooling purposes, housing 38 is shown with coolant passages 42 communicating with the head passages 32. Additionally, circumferential cooling fins 44 are spaced along a major portion of the length of housing 38 for air cooling of valve 22 for increased heat dissipation.

Extending laterally from housing 38 are intake and exhaust manifold connections 46, 48, respectively, one atop the other. Valve 22 rotates to permit communication between such connections and combustion chamber 26 in a sequence more fully explained below. For this purpose, valve 22 is provided with radial recesses 50, 51 in the shape of an arc sector such as preferably about 50° and thus so adapted as when valve 22 is in the orientation of FIG. 1, recess 50 will provide communication between intake connection 46 and a port 52 opening through the cylinder into combustion chamber. Upon a further 90° of valve rotation, recess 51 will be brought into registry (FIG. 6) with exhaust connection 48 and then also with port 52 opening into the combustion chamber.

Thus, there are two such recesses 50, 51, but of different lengths and separated by 90° interval, for movement in succession into registry with a single port 52 into combustion chamber 26.

Cylinder head 34 is also provied with a threaded bore 56 for receiving a spark plug 57 which is conventionally energized, with its placement being shown in FIG. 6.

As shown, recesses 50, 51 are such as to provide 2°–5° of advance or delayed intake and exhaust overlap, which may be, of course, varied as the designer may prefer. Other valve variations are also possible.

Indeed the possible variations of the intake and exhaust passages and combinations of corresponding channels or recesses within valve 22 are myriad, opening up to the skilled designer a wide variety of choices for achieving a desired degree of valve overlap, not to mention making possible the provision also in the single valve 22 auxiliary passages such as for delivery of a small precharge of fuel-air mixture to thus allow combustion to be initiated with advanced ignition timing as for achieving a more uniform combustion, even with lean mixtures, in order to reduce preignition and pinging.

In any event, there will be seen to be provided at least one valve passage or recess for providing communication between intake and exhaust passages, as are provided by connectors 46, 48 and the combustion chamber as the valve rotates. Demonstrably, therefore, the new high efficiency kinetic occlude system through its novel valve orientation, wherein a lower end face 58 of valve 22 is brought into immediate, parallel adjacency to the cylinder head 34 just above the combustion chamber, permits the skilled designer to select a timing relationship for intake and exhaust cycles which will make possible the use of fuel of minimum octane.

Further, the system design is amenable for use also with two-stroke cycles of operation as well as in diesel engines of both four-cycle and two-cycle design. However, in the case of two-stroke modes of engine operation, 90° separation of inlet and exhaust passages will not be used, but replaced by 180° separation, but with angular shifts in general of several degrees being possibly used, as for advanced or retarded opening, as desired. The possibilities are indeed unlimited by the new system.

Regardless of such ultimate engine design modes of choice which dictate different passage locations in valve 22 and possible relocations of inlet and exhaust connections 46, 48 relative to valve 22, valve 22 is caused to be rotatably driven in periodic angular intervals with each upstroke and downstroke of piston 18, by a one-way drive mechanism.

However, before discussing the mechanism for providing such operation, it will be seen in FIG. 1 that sealing between valve 22 and housing bore 40 is provided by an O-ring 60, above which a substantial solid portion of valve 22 is present for achieving a desired thermal transfer of heat generated in the lower portion of valve 22 during engine operation, which heat is readily extracted by coolant in passages 42 and by fins 44. Thus, the new valve arrangement offers marked resistance to the ravages of high operating temperatures which cause valve erosion in conventional valve arrangements, including relatively early rotating valve designs not offering the many advantages of the new system of this invention.

In addition, it will now be apparent that shaft 24 is caused to reciprocate centrally within valve 22 upon piston reciprocation, and valve 22 has a central, axial bore 62 for that purpose, an O-ring 64 at the lower end of bore 62 provides sealing about the periphery of shaft 24, and an oil ring if needed.

For providing a low-friction rotational relationship between valve 22 and its housing 38, the inner surfaces or bore 40 of the housing, as well as lower valve face 58 may be coated with molybdenum disulphide but, of course, lubricating oil under pressure may be supplied by conventional oil passages (not shown) to housing 38. Also, for heat transfer control, annular recesses 54 are spaced along valve member 22. The skilled designer may take other steps to prevent excessive valve cooling. Shaft 24 can be slightly hollowed with oiled passages for being lubricated as by splash lubrication from the piston.

However, it should be clearly understood that said annular recesses 54, which provide in effect equally spaced rings along the outer surface of valve 22, necessarily must stop short of the region of the valve member which contains the intake passage 50 as well as the exhaust passage 51. Thus, referring to FIG. 3, it will be seen there are arcuate sectors, namely those containing intake and exhaust passages 50, 51 in which two sectors the annular recesses 54 are not provided, and such is desirable not only to permit the greatest possible use of the radius for such intake and exahust passages, but also to enhance the thermal transfer characteristics between the valve member and its housing 38 in such regions or sectors which contain the equipment intake and exhaust passages 50, 51.

Similarly, there are provided in the lower surface of valve 22 a series of grooves or recesses 55, but such are preferably not concentric relative to the axis of rotation of the valve. Instead, they are preferably eccentric or oval so that they will provide a scrubbing or sweeping action as the valve 22 rotates and thereby have the effect of sweeping carbon pieces or other particulate matter from the lower face or floor of the cavity in which valve 22 rotates, as such will be caused to enter port 52 and thus be burned during combustion and ultimately be discharged in the exhaust stream. However, just as with annular recesses 54, such grooves or recesses 55 terminate short of the intake passage 50 and exhaust passage 51. Such grooves or recesses 55 reduce friction and provide a proper heat transfer relationship relative to valve 44.

Valve 22, rather than being machined precisely, could advantageously be formed by casting and then providing with a laminated coating as of molybdenum disulphide which will provide a smooth, very low friction surface in spite of the underlying casting irregularities.

Turning now to the mechanism for rotating valve 22, there is provided at the upper end of housing 38 a slip-ring assembly, generally designated 66, which includes washer-like elements which are termed slip ring drivers, there being an upper such driver 68 and a lower such driver 68' for driving corresponding upper and lower slip rings 70, 70' rotationally in response to reciprocation of shaft 24.

Shaft 24 carries a reduced diameter extension 72 at the upper end which is provided with flutes or keys 74 spirally wound about its length, each circumscribing an arc of approximately 90° for sliding interengagement with the slip ring drivers 68, 68'. The latter are each of the configuration shown in FIG. 4, having an annular body 76 having a flanged portion 78 of slightly increased diameter provided with a sawtooth-like driving surface 80 forming four ramped surfaces 82 separated by vertical surfaces 84. A central bore 86 is sized for close tolerance sliding engagement with shaft extension 72.

Opening on one side of bore 86 is a vertically extending narrow slot or keyway 88 for slidable engagement with one of said flutes or keys 74 whereby, as said shaft extension 72 slides up or down, driver 68 will be turned through an arcuate angular sector of substantially 90° with each full extension or retraction of extension 72. Opposite from slot 88 is another slot 90 but of approximately 90° arcuate extent for receiving the opposite flute or key 74 whereby only one key 74 will provide rotation of the driver 68 and the other will be free to translate within the larger such slot 90.

The sliprings 70, 70' are of the same general configuration of slip ring drivers 68, 68' but have a central bore of sufficient diameter whereby they will not be engaged by either of said keys 74 but will be driven rotationally by a corresponding one of drivers 68, 68' as the latter rotates on reciprocation of shaft extension 72. For this purpose, spiral compression spring 92 has a relatively light spring constant, thus lightly urging driver 68, 68' apart and into engagement with the corresponding slip-rings 70, 70'.

However, as will be apparent, movement of shaft extension 72 in either direction will by the frictional engagement with drivers 68, 68' cause a corresponding one of them to be lifted or urged away from its corresponding slipring. For example, if extension 72 is driven up, driver 68' will by frictional engagement with one of the keys 74, and the surface of extension 72 be lifted from its slipring 70', while driver 68 will remain in firm driving engagement with its corresponding slipring 70 and resulting in rotation of slipring 70 by the driven engagement of driver 68 as it follows the spiral key 74 riding in keyway 88. Then, upon extension 72 moving downwardly with downward movement of piston 18, driver 68 is carried by frictional engagement away from its engagement with extension 72 out of driving engagement with slipring 70, while slipring driver 68' provides rotation of its corresponding slipring 70'.

As will be seen, each of sliprings 70, 70' is driven in the same direction of rotation about the longitudinal axis of extension 72 by reciprocating movement of piston 18. Valve 22 is driven by sliprings 70, 70'. For this purpose, there is provided a sleeve 22' which constitutes an integral extension of valve 22, being part of the same valve 22, although appearing to be separate by virtue of the illustration of a pin bore 110, which is explained below, the same being pinned as by pins 96 spaced radially about the lower periphery of slipring 70'. At the upper end of collar 22', which is an extension of valve 22, slipring 70 is provided with a flange 96 of enlarged diameter through which extend screws as at 98 threaded into collar 94. Hence, rotation of either of sliprings 70, 70' will provide corresponding rotation of collar 94 and thus valve 22. Housing 38 is provided at its upper end with an enlarged diameter portion 100 for receiving said collar 94. A retainer ring 102 is fitted atop said portion 100 and threaded to same as by screws 104 whereby collar 94 and valve 22 are retained within said housing 38.

Also to be noted is a detent pin assembly 101 which may include a spring-loaded ball or tip t fitting into one of corresponding recess of valve 22, there being for example four such recesses spaced evenly at 90° increments about the valve periphery whereby the valve as driven by assembly 66 will register precisely and incrementally.

A guard or shield 106 is provided atop extension 38, being of thin metal or synthetic material for providing a shroud or housing of protective nature for extension 72. Shield 106 is only partially illustrated in FIG. 1, being broken away for illustrative purposes but of sufficient height for enclosing extension 72 when piston 18 is at its top dead center position.

The arrangement is such as to greatly eliminate the valve mechanism mass associated with the designs of the prior art, resulting in the use of a single valve member 22 which is only driven in a single direction of rotation without being required to rapidly be oscillated or moved up and down with rapid acceleration as required by tulip valves and the like. This reduces the overall weight of the cylinder head assembly most advantageously resulting in minumum mass and freedom from the high internal forces and structural stresses typical of conventional valve arrangements for internal combustion engines.

An additional advantage of the invention will be seen to be realized by the use of shaft 24 and its extension 72 since the latter in effect guides or stabilizes piston 18 during a reciprocation whereby piston 18 may be of much shallower depth overall and thus greatly decreased mass and material extent, as contrasted with prior art designs. Shaft 24 may be cast, swedged, keyed or pinned to piston 18 and may, for example, be of the same material. Extension 72 is preferably fitted to shaft 24 as by being threaded as at 108 at the upper end of shaft 24. Similarly, shaft 24 may be threaded into a corresponding bore 110 of piston 18. For facilitating of removal of the valve assembly, a lateral bore 110 extends across the upper end of valve 22, there being also corresponding bores as at 112 opening from opposite sides of housing 38 in alignment with bore 110, whereby a pin may be inserted therethrough for locking shaft 72 against rotation to permit removal of shaft 72 for disassembly, or replacement.

In operation, four cycles of engine operation are realized in the construction illustrated, namely, intake, compression, combustion, and exhaust. Upon an intake stroke initiated from the orientation of the apparatus shown in FIG. 1, the usual air-fuel mixture, as from a carburetor (not shown) will be drawn through intake passage 46 into combustion chamber 56 as piston 18 moves downwardly within its cylinder 28. Orientation of keys 74 is preferably such that passage 50 will be oriented for communication with passage 46 to permit intake through port 52 for a major portion of such stroke. However, passage 50 may be of wider or lesser extent than as shown in FIG. 3, or may be oriented with angular displacement for producing the desired degree of intake and dwell. The new design is inherently "self-timing" as compared with prior art arrangements using timing belts and other complicated mechanisms.

As piston 18 reaches the bottom of its stroke, rotation produced by corresponding movement of shaft extension 72 will cause passage 50 to be moved out of communication with intake passage 46 and with port 52 for causing now combustion chamber 26 to be closed as a compression stroke results from the movement upward of piston 18. At or near the top of its stroke, as is conventional, ignition is produced by a conventional spark plug within bore 56 and resulting in a combustion or power stroke as piston 18 now is driven downwardly within cylinder 28. Valve 22 during each such stroke is caused to rotate through 90° of movement until, now, as piston 18 again reaches the bottom of its stroke, keys 74 will cause rotation of valve 22 through a further 90° of movement providing communication by passage 50 between port 54 and the exhaust connection 48 whereby exhaust gases will be driven from combustion chamber 26 as piston 18 moves toward its top dead center position once more. Hence it will be apparent that valve 22 rotates with 90° movements, i.e., increments.

If such apparatus were instead utilized in accordance with the invention for two-stroke operation, it is apparent that keys 74 would preferably be oriented for 180° angular rotation of the valve member, rather than 90°.

In addition, to the numerous advantages of the present arrangement of low friction, elimination of separate intake and exhaust valves for each cylinder, and elimination of the usual cam shaft, push rods, followers, timing chains, gears and all other exhaust parts and moving elements heretofore utilized in conventional internal combustion engines, the invention also provides an engine design which is intrinsically capable of better breathing and the development of combustion insensitive to variations in fuel quality, temperatures or ambient atmospheric conditions. There results an engine which runs quietly, economically, and cleanly, i.e., with a minimum of pollutants and undesired by-products of combustion.

Combustion design is an important consideration which has been kept in mind in the new configuration. By way of brief explanation of the theory relevant to this new design, when the spark initiates the ignition and burning of the compressed and heated mixture in the combustion chamber 26, such preferably occurs while the piston is still rising to the end of its compression stroke, but with ignition in response to the spark travelling through the mixture in all available directions with great speed and intensity. If the mixture is hot and turbulent, the flame front will travel with great velocity. But the speed of combustion must be initiated at a point relative to dead center of piston 18 such that there will not be detonation, or as otherwise would produce problems typically occuring when using low grade fuels having lower octane ratings. In an Otto-cycle engine fueled,for example, by gasoline, if detonation were to occur, it would result in the flame front trapping a mixture or pocket which, as it keeps advancing, is compressed and heated to a point where such pocket of the combustible mixture is ignited spontaneously. Such may occur also if there is an incandescent deposit which may initiate another flame front which can increase the pressure with the two fronts of combustion in opposition.

Unequal ignition of this kind is eliminated by configuring piston 18 in accordance with the present invention, wherein the crown of piston 18 provides combustion chamber 26 with a hollowed or tapered configuration for allowing the combustion mixture to undergo a gradual squishing as the piston approaches top dead center. Thus, piston 18 is provided with a recess 114 of tapered configuration, said recess providing an arcuate portion 116 of the piston crown which is flat but tapering uniformally from opposite sides of the flat region 116 to provide a point 118 of deepest extent opposite from flat region 116, which point is located substantially below the spark plug in its bore 56.

Such recess allows the mixture to be directed toward the spark plug and resulting in ignition such that the fuel mixture is fed into the advancing flame front and causing fuel to be burned without exhaust residuum. As will be seen from FIG. 1, when piston 18 is at its top dead center position shown, as will be the case at the point just after ignition is initiated, additional space is provided in the region of the spark plug in bore 56 whereby there will be an appropriate build-up of heat in the charge of mixture within the combustion space. This causes the flame front to be advanced smoothly around both sides of shaft 24 for smooth, detonation-free combustion.

However, such build-up of heat in the charge of the mixture must not be permitted to abate or cool too quickly since otherwise the mixture will not burn fully, resulting in what is termed "quenching" and causing a large part of fuel exhaust pollution in conventional engine designs. By the design thus utilized, wherein said recess 114 is of tapered extent on opposite sides of the flat portion 116 and toward the spark location, there is produced a sudden squeeze in the space occupied in the fuel and air mixture as piston 18 rises toward the cylinder head, causing the mixture to be forced or squished by high speed or velocity out of the region 120 over said flat portion 116, and into the remaining combustion space of chamber 26. This increases the mixture turbulence and forces the mixture toward the flame front for better combustion. The V-shaped flat region 116, which preferably includes an angular extent of about 50° of the piston crown on the side of extension 24 opposite from the point of ignition, produces a gradual squish of the combustion chamber before the piston reaches top dead center and before ignition, during which the mixture advances smoothly toward the point of ignition by the spark plug and bore 56 and resulting in fuel being completely burned without substantial exhaust residuum. Such design results in the flame being delivered with appropriate surface volume ratios for superior combustion. Preferably, for such purpose, said recess 114 tapers from the flat region 116 at about 10°. The configuration of the piston and location of the spark plug relative to the shaft 24 carried by the piston provides a virtually ideal configuration for combustion, as the combustion mixture is squished during the compression stroke as the piston approaches its position up against the cylinder head and the resultant high velocity forcing of the mixture out of the region over piston portion 116 and into the tapering recess 114 causes the mixture to be forced toward the flame which has been ignited by the spark plug for better combustion. However, one is also concerned about the formation of oxides of nitrogen. To control the sudden pressure rise in the new design, the tapering recess 114 allows the squishing to be gradual before the piston reaches top dead center and ignition occurs. The resultant smooth advance of the mixture, as noted above, minimalizes the formation of the various oxides of nitrogen. Therefore, the design makes use of ideal flame travel with good surface volume ratios appropriately for the avoidance of problems of this type. Also, no gases are trapped behind shaft 24. The configuration of the piston relative to the cylinder head as utilized in the present invention produces a combustion efficiency which is essentially 1.0 or very nearly so. It should also be realized that the location of the intake passage 46 above the exhaust passage 48 causes the former to be heated by the latter with warming of the intake mixture as it enters the cylinder thereby taking place. This preheating is also advantageous.

While the above description makes reference to the use of gasoline and diesel fuels or combustion using such fuels, this is not intended to rule out use of the present invention in constructing engines which operate on propane, LP and so forth.

A further advantage which will not be immediately apparent from the drawings relates to the configuration of the piston. In conventional engine design, it has become a matter of good practice to machine the piston with a slightly eliptical configuration. It is beyond the present need for descriptive purposes to explain why this is done, but it is important to recognize that the invention by the use of shaft 24 results in the piston being more stably oriented in its stroke and without the need for the deep skirt which is typical of conventional piston designs. For these reasons, machining of the piston may be such that it is perfectly circular. The importance of this from an economic and manufacturing viewpoint will be readily appreciated.

Prior art designs for engines wherein conventional tulip valves are used necessarily must accommodate the opening and closing of the valve. Thus, they typically have recesses formed in either the head or in the piston, or a combination of both, so that the requisite room for valve movement is obtained. Such cavities, whether located in the head or in the piston, for conventional valves disturb the gas flow and present problems during the combustion process. The disturbance of gas flow may result in oxides of nitrogen. Since the new valve configuration of the invention eliminates the need for such cavities or other irregularities within the combustion chamber, a smooth gas flow is achieved during the firing cycle and with the advantages of same being thereby utilized in an ideal manner, and preventing, as explained, formation of nitrogen oxides.

Although the foregoing includes a description of the best mode contemplated for carrying out the invention, various modifications are contemplated.

For example, the scope of the invention is not limited to strictly mechanical actuation of valve drive mechanism 66 which could instead by actuated using hydraulic principles wherein the reciprocation of the piston may be accompanied by hydraulic reciprocation for pumping action of an element like shaft extension 72 to achieve rotation of valve 22.

As various modifications could be made in the constructions herein described and illustrated without departing from the scope of the invention, it is intended that all matter contained in the foregoing description or shown in the accompanying drawings shall be interpreted as illustrative rather than limiting.

Reference is made to disclosure document No. 123,018, filed Dec. 14, 1983, which is incorporated herein by reference. Preservation of such disclosure document, entitled "High Efficiency Performance Kinetic Occlude System with Rotary Valve" is hereby requested.

What is claimed is:

1. In an internal combustion engine including at least one cylinder and a piston reciprocal in the cylinder, a rotary valve apparatus for providing high efficiency performance kinetic occlusion of intake and exhaust gases for the cylinder and comprising a valve housing extending above the cylinder, a rotary valve positioned within the housing for rotation about an axis extending in the direction of reciprocation of the piston, at least one passage within the valve for providing communication between at least one port opening into the combustion chamber and exhaust and inlet gas conduits, a shaft carried by and extending above the piston centrally through the valve for reciprocation of the piston, and one-way drive means interconnecting the shaft for rotatably driving the valve in a single direction of rotation about its axis of rotation for providing interconnection by said valve between the combustion chamber and the exhaust and inlet gas conduits, the drive means including structure spirally engaging said shaft for causing an incremental rotation of the valve in said single direction for each stroke of the piston during reciprocation thereof, whereby the valve is incrementally advanced in said single direction during one piston stroke direction and further incrementally advanced in said single direction during an opposite piston stroke direction.

2. Appartus at set forth in claim 1 wherein the shaft defines a spiral structure, the drive means including rotatable ring means with corresponding drive structure for following the spiral structure during each piston stroke to produce rotation of the ring means, and ratchet-defining means for interengaging the valve and ring means for producing rotation of the valve through a first arcuate extent when the piston moves in one stroke direction and for producing rotation of the valve through a second further arcuate extent when the piston moves in an opposite stroke direction.

3. Apparatus as set forth in claim 2 wherein the spiral structure defines plural spiral wound in opposite directions about the rotatable drive means being constituted by a pair of rings each adapted for following only a respective one of the spirals.

4. Apparatus as set forth in claim 2 wherein the rotatable ring means comprises first and second slip ring drivers, the valve carrying first and second slip rings means for engagement by the slip ring drivers, and means resilient urging the slip ring drivers apart and into engagement with the slip ring means, the slip ring driver engaging the spiral structure of said shaft such that reciprocation of the shaft causes the slip ring drivers to alternately engage the slip ring means.

5. Apparatus as set forth in claim 4 wherein the slip ring drivers and slip ring means each comprise mutually configured opposed surfaces of sawtooth configuration for ratcheting, one-way drive engagement therebetween.

6. Apparatus as set forth in claim 1 wherein the valve includes a body of generally cylindrical shape positioned within a bore of the valve housing for rotation about an axis coincident with axis of cylindricity of the cylinder, the one-way drive means being located above the valve body.

7. Apparatus as set forth in claim 6 wherein said at least one port opens into the valve housing port beneath the valve body, the exhaust and inlet gas conduits opening into the side of the valve housing, said valve passage providing flow of gases longitudinally through the valve body for communication with the respective gas conduit.

8. Apparatus as set forth in claim 7 wherein the valve housing is of double-walled construction for circulation of coolant about the valve.

9. Apparatus as set forth in claim 8 wherein the valve housing includes cooling fins about its exterior.

10. Apparatus as set forth in claim 6 wherein the shaft extends longitudinally through a central bore of the valve, and seal means carried by the valve for gas tight sealing between the valve bore and the shaft.

11. Apparatus as set forth in claim 6 wherein a point of combustion mixture ignition is defined by a spark plug or the like located within the combustion chamber to one side of the shaft, the piston including a central recess about the shaft and of predetermined angular extent to provide a point of deepest extent proximate the point of ignition.

* * * * *